United States Patent [19]

Rance

[11] 4,395,012

[45] Jul. 26, 1983

[54] SUPPORT FOR A MAILBOX

[76] Inventor: Frederick K. Rance, 402 14th St., Rte. 1, Devils Lake, N. Dak. 58301

[21] Appl. No.: 323,341

[22] Filed: Nov. 20, 1981

[51] Int. Cl.[3] ..... F16M 13/00

[52] U.S. Cl. ..... 248/545; 248/128; 248/417; 232/38

[58] Field of Search ..... 248/128, 415, 545, 146, 248/145, 417, 131, 156; 232/38, 39; 52/40, 165, 157, 297, 298; 403/109, 377, 104

[56] References Cited

U.S. PATENT DOCUMENTS

| | | | |
|---|---|---|---|
| 1,646,064 | 10/1927 | Obermeyer | 248/146 |
| 2,317,818 | 4/1943 | Skulkety | 403/377 X |
| 2,552,915 | 5/1951 | Zachrich | 232/39 X |
| 2,738,941 | 3/1956 | Laurich et al. | 248/145 |
| 3,011,598 | 12/1961 | Galloway | 52/157 |
| 3,658,284 | 4/1972 | Haasl | 248/145 |

*Primary Examiner*—James T. McCall
*Assistant Examiner*—Sarah A. Lechok
*Attorney, Agent, or Firm*—Berman, Aisenberg & Platt

[57] ABSTRACT

A support unit comprises a ground base unit made of a sturdy pipe having annular washers. The holes in the washers are aligned and adapted to receive a support pipe which extends above the ground base unit for supporting an object such as a mailbox. The object is rotatably attached to the support pipe with elastic elements which return the object to a predetermined orientation after displacement. Also, if the support pipe is damaged, it is easily replaced.

6 Claims, 3 Drawing Figures

SUPPORT FOR A MAILBOX

TECHNICAL FIELD

This invention relates to support for objects such as a mailbox.

BACKGROUND ART

Mailbox supports are known in the art and have developed in many different directions. Of relevance to the present invention are mailbox supports with particular ground attachment mechanisms, and mailbox supports which protect the mailbox from damage due to accidental collision.

Mailbox supports with particular ground attachment means are shown by U.S. Pat. Nos. 3,011,597 and 3,011,598 to Galloway et al., and by U.S. Pat. No. 2,738,941 to Laurich et al. The patents to Galloway et al. show a ground attachment means which includes a pipe with an auger on one end and a vane structure on the upper end of the ground attachment device. The pipe extends above the ground so as to be received by another pipe to which the mailbox is attached. The ground attachment device described in the Galloway et al. patents suffers from the disadvantage that when the mailbox support pipe is removed, a large portion of the ground attachment device extends above the level of the ground. In the mailbox support shown by Laurich et al the ground attachment device comprises a pipe with vanes on it which is inserted into the ground so that a large part of the ground attachment device extends above the ground for receiving the mailbox support pipe.

Devices for absorbing the shock of a collision with the mailbox are shown in the U.S. Pat. Nos. 2,550,338 to Dunagan and 4,213,560 to Hall. These devices include platforms which are attached to the mailbox support pipe via a bolt so that the mailbox platform rotates about the axis of the bolt.

STATEMENT OF THE INVENTION

In the mailbox support of the invention the ground base unit is a large sturdy pipe which is inserted into the ground so that the top of the pipe is essentially flush with the ground level. The large sturdy pipe has two annular washers welded therein with aligned central holes, which are adapted to receive a pipe which supports the mailbox. The pipe supporting the mailbox fits inside of the ground base unit and may have a collar which is adjustable along the pipe support for cooperation with the top of the ground base unit for determining the height of the mailbox above the ground. When it is desired to temporarily move the mailbox, one need merely pull the mailbox support pipe out of the ground base unit, and when it is desired to remount the mailbox, the pipe may merely be reinserted into the ground base unit. Also, if the support pipe is damaged, it is easily replaced. The ground base unit may also have a simple pipe clamp welded to the top thereof to secure the mailbox pipe to the ground base unit. In this case the clamp must be released before the support pipe is removed.

Also the ground base unit may have dirt auger blades to facilitate insertion of the ground base unit into the ground. When it is necessary to remove the ground base unit, the annular washers may be grasped by a hook and the base unit pulled out of the ground by means of a jack or other element.

The mailbox platform of the invention is attached to the pipe supporting the mailbox in a simple and inexpensive manner. A pipe coupling is welded to the mailbox base plate and then is secured onto a threaded upper portion of the support pipe. A pipe clamp is welded to the lower part of the pipe coupling so that it may grasp the mailbox support pipe. By adjusting the diameter of the pipe clamp, the resistance to rotation of the mailbox may be varied. Additionally, a second pipe clamp is located on the mailbox support pipe below the mailbox and is attached to the first pipe clamp by means of springs. The cooperation of the spring's attraction and the friction between the first pipe clamp and the mailbox support pipe provide a simple and efficient mounting means which protects the mailbox against damage due to accidental collision.

DETAILED DESCRIPTION OF THE INVENTION

Figure 1:
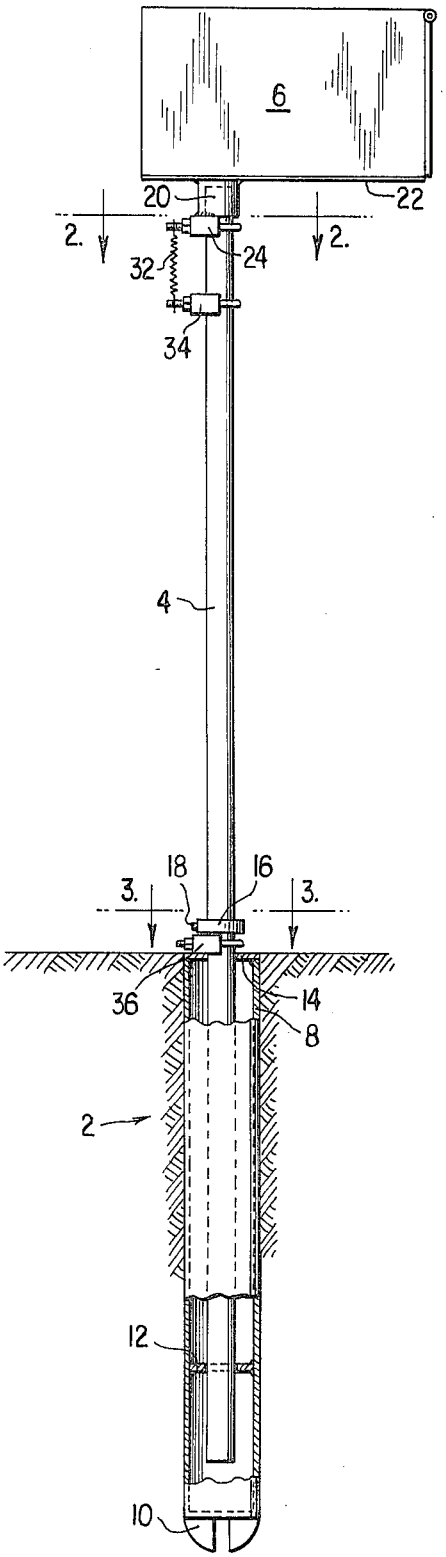
FIG. 1 shows an overall view of the inventive mailbox support including a cross section of the ground base unit.
Figure 2:
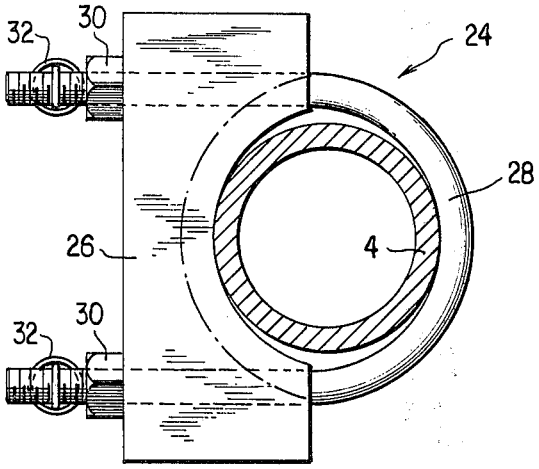
FIG. 2 shows a cross section taken along line 2—2 of FIG. 1.
Figure 3:
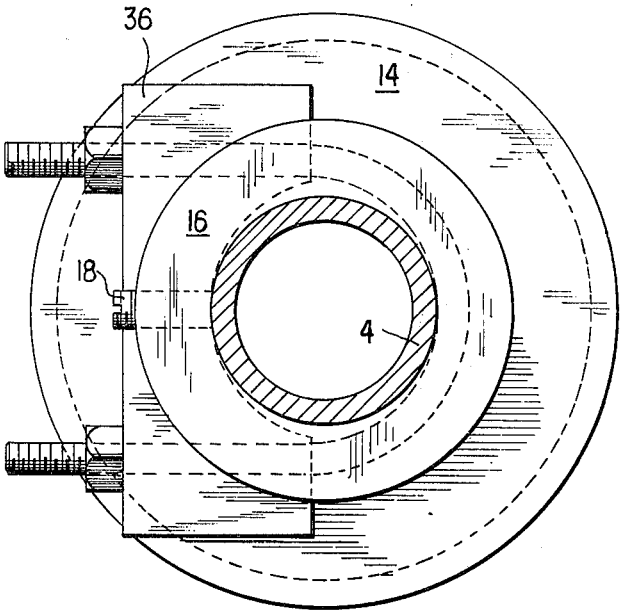
FIG. 3 shows a cross section taken along line 3—3 of FIG. 1.

The mailbox support unit of the invention is shown generally in FIG. 1. A ground base unit 2 is shown buried in the ground and a support pipe 4 is shown being supported by the ground base unit. The support pipe 4 supports a mailbox 6.

The ground base unit 2 is constructed of a very sturdy large diameter pipe 8. Located on the bottom of the pipe are dirt auger blades 10 to enable the ground base unit to be turned into the ground. Since the diameter of the auger blades is less than that of the pipe 8, the ground base unit may be removed without having to rotate the pipe 8. Welded to the interior of the pipe 8 is a first annular washer 12, for supporting a lower end of pipe 4. Welded to the upper end of the pipe 8 is a second annular washer 14 for supporting an upper portion of the pipe 4. The washers 12 and 14 are of sturdy construction and have the holes aligned so that the support pipe 4 may be freely inserted into the ground base unit. The washers provide an additional function in that when the ground base unit is to be removed from the ground, one may easily grasp the ground base unit by using a hook to engage one of the annular washers. A chain with a hook on it is lowered into the ground base unit and the hook is engaged with one of the annular washers, the ground base unit is then raised out of the ground easily.

The ground base unit may be installed in the ground in any known manner. One technique, particularly adapted to the inventive apparatus is to insert the support post into the base unit and work the base unit into the ground.

The height of the support pipe 4 above the ground level is maintained by the position of a locking collar 16 along the pipe 4. The locking collar 16 is an annular collar with a set screw 18 which secures it to the pipe 4. The function of the locking collar 16 is to carry the weight of the support pipe 4 and the mailbox 6. When it is desired to change the height of the mailbox above the ground, the position of the locking collar need merely be adjusted along the pipe 4. If it is desired to remove the mailbox 6 and support pipe 4, as for example, to temporarily store the mailbox or to remove the mailbox due a wide load on the road, one need merely remove the support pipe 4 from the ground base unit while leaving the locking collar 16 secured to the support pipe 4. When the support pipe 4 is reinserted into the ground base unit, the previous level of the mailbox 6 will be maintained without adjustment.

The mailbox 16 is attached to the support pipe 4 by way of a mechanism which allows the mailbox to rotate with respect to the support pipe so that if the mailbox is accidentally hit, it will rotate to avoid damage to the mailbox. A pipe coupling 20 is welded at one end to a base plate 22 of the mailbox. The pipe coupling is then screwed onto a threaded end of the support pipe 4 so that the pipe coupling is supported by the support pipe 4 and yet freely rotates with respect to the support pipe. A first pipe clamp 24 has a semicircular base portion 26 and a U-shaped bolt 28. The semicircular base 26 is welded to the lower portion of the pipe coupling 20. The pipe 4 is then clamped between the U-shaped bolt 28 and the base 26 by tightening the nuts 30. The resistance to rotation of the mailbox 6 with respect to the support pipe 4 may be adjusted by adjusting the clamping pressure of the clamp 24. The mailbox is returned to its original position after rotation by means of springs 32 which extend between the first pipe clamp 24 and a second pipe clamp 34. The second pipe clamp 34 is securely clamped to the support pipe 4 and the springs are attached to the ends of the U-shaped bolts of the respective pipe clamps. When the mailbox 6 is rotated with respect to the support pipe 4, the springs are extended and the restoring force of the springs tends to return the mailbox 6 to its original position with respect to the support pipe 4.

A third pipe clamp 36 may be attached, for example by welding, to the second annular washer of the ground base unit between the second annular washer and the locking collar 16. This pipe clamp 36 secures the support pipe 4 to the ground base unit 2 but allows for easy removal of the support pipe 4 by merely loosening the nuts on the pipe clamp. This arrangement is advantageous since when the support pipe 4 is removed pipe clamp 36, sits at ground level with 1 inch of loose dirt beveled out around base unit, thus effectively providing a ground base unit which is level with the surface of the ground.

There has been shown a novel mailbox support arrangement which is easy to construct and is sturdy and provides the advantage of being easily removable. The inventive support system is flexible since the ground base unit may be easily removed and reinserted at another place in the ground. Also the support pipe 4 may be removed and reinserted with great facility.

In a working embodiment of the invention, the pipe 8 is a 2½' section of 4" well casing, the washers are 4" in diameter and ¼" thick, and the support pipe 4 is a 5'7½" section of 1½" well pipe.

The foregoing description is only illustrative of the principles of the invention. Numerous modifications may be made, such as by using the invention to support a plurality of objects, or by using non-circular pipes, and any such modification is considered to be within the scope of the invention.

What is claimed is:

1. A support comprising:

a first hollow cylindrical element having a cylindrical axis and an inner cavity having a first cross-sectional dimension, two annular washers, each attached to said first cylindrical element and each having a central hole having a diameter smaller than said first cross-sectional dimension and aligned with an axis generally parallel with said cylindrical axis of said first cylindrical element, support means for supporting an object and adapted to be received in said central holes and thus held by said two annular washers, a locking collar adapted to be secured to said support means, for preventing relative motion in the direction of said cylindrical axis, beyond a predetermined point, between said support means and said first cylindrical element, and means for attaching an object to said support means.

2. The support of claim 1 comprising:

auger blades attached to one end of said first cylindrical element and having a maximum dimension in a plane transverse to said cylindrical axis less than that of said cylindrical element for permitting said cylindrical element to be easily inserted into the earth.

3. A support comprising:

a first cylindrical element, two annular washers, each attached to said first cylindrical element and each having a central hole aligned with an axis generally parallel with the axis of said cylindrical element, support means for supporting an object and adapted to be held by said two annular washers, a locking collar adapted to be secured to said support means, for preventing relative motion, past a predetermined point, between said support means and said first cylindrical element and, means for attaching an object to said support means;

wherein said support means comprises a second cylindrical element having threads on one end, and said means for attaching an object to said support means comprises:

a plate for supporting said object, a threaded cylindrical element, secured at one end to said plate, for mating with said threaded portion of said support means, means attached to said threaded element, for frictionally grasping said support means, elastic means connected between said threaded cylindrical element and said support means for returning said plate to a predetermined orientation with respect to said support pipe after rotational displacement of said plate.

4. The support of claim 3 comprising:

a clamp attached to said first cylindrical element for releasably securing said support means to said first cylindrical element.

5. The support of claim 4 wherein:

said locking collar comprises a section of pipe which fits over said second cylindrical pipe and includes a set screw for securing said locking collar to said second cylindrical pipe.

6. The support of claim 5 wherein:

said object is a mailbox.

* * * * *